US005121528A

United States Patent [19]

Tanaka

[11] Patent Number: 5,121,528

[45] Date of Patent: Jun. 16, 1992

[54] BUCKLE DEVICE FOR SEATBELT SYSTEM

[75] Inventor: Kohbun Tanaka, Aichi, Japan

[73] Assignee: Kabushiki Kaisha Tokai-Rika-Denki-Seisakusho, Japan

[21] Appl. No.: 600,918

[22] Filed: Oct. 22, 1990

[30] Foreign Application Priority Data

Oct. 23, 1989 [JP] Japan ..... 1-123703[U]

[51] Int. Cl.[5] ..... A44B 11/25

[52] U.S. Cl. ..... 24/641; 24/636

[58] Field of Search ..... 24/641, 636, 637, 633, 24/640

[56] References Cited

U.S. PATENT DOCUMENTS

| | | | |
|---|---|---|---|
| 4,451,958 | 6/1984 | Robben et al. | 24/641 X |
| 4,454,634 | 6/1984 | Haglund | 24/636 |
| 4,562,625 | 1/1986 | Doty et al. | 24/641 X |
| 4,802,266 | 2/1989 | Doty et al. | 24/641 X |
| 4,876,772 | 10/1989 | Anthony et al. | 24/641 X |

FOREIGN PATENT DOCUMENTS

| | | | |
|---|---|---|---|
| 2071753 | 9/1981 | United Kingdom | 24/641 |

*Primary Examiner*—Laurie K. Cranmer

*Attorney, Agent, or Firm*—Sixbey, Friedman, Leedom & Ferguson

[57] ABSTRACT

A buckle device is provided, for use with a seatbelt system of a vehicle, into which a tongue plate is inserted for engagements with a lock member, and which has in addition to the lock member with which the tongue plate engages when it is inserted into the buckle device to a predetermined depth, and which is urged at all times in the direction of engagement with the tongue plate, an ejector for urging said tongue plate in the direction of withdrawal from said buckle device, and a preventing member for preventing the lock member from moving into the insertion path of the tongue plate until the tongue plate reaches the predetermined engagement position.

With such an arrangement, the tongue plate undergoes no frictional force deriving from the lock member, and unless the tongue plate is inserted to the predetermined depth where it can firmly engage with the lock member, the ejector drives the tongue plate back out of the buckle device, thereby assuring reliable engagement between the tongue plate and the lock member.

20 Claims, 4 Drawing Sheets

BUCKLE DEVICE FOR SEATBELT SYSTEM

BACKGROUND OF INVENTION

1. Field of the Invention

The present invention relates to a buckle device for seatbelt systems of motor vehicles and so forth.

2. Description of the Related Art

In a buckle device, it is desirable that frictional force in the insertion/withdrawal path of the tongue plate be limited as far as possible during the period following the insertion of the tongue plate until a lock plate securely engages therewith. In one arrangement devised to meet the above-mentioned requirement, failure to fully insert the tongue plate into the place where it securely engages with the lock plate causes a spring-loaded ejector to push the tongue plate back out of the buckle device, whereby it is assured that tongue plate insertion and tongue plate's firm engagement with the lock plate are promoted.

However, it is noted that the lock plate is at all times urged in a direction towards the path of tongue plate insertion so that the lock plate may be readily and immediately engaged with the tongue plate when the tongue plate is inserted and reaches the engagement position. Due to the urging of the lock plate towards the tongue plate the tongue plate confronts a pushing force from the lock plate while the tongue plate is being inserted into the engagement position, with some frictional resistance being generated thereby. In some cases, to lessen the frictional resistance, certain measures are taken wherein the faces of the lock and tongue plates are processed so as to be smooth, and a large ejector spring is applied to provide the ejector with larger spring force, requiring greater force for tongue plate insertion.

SUMMARY OF THE INVENTION

Accordingly, it is an object of the present invention to provide a buckle device arranged with the above-mentioned fact in view, wherein the lock plate is kept away from the locus of tongue plate insertion until the tongue plate reaches the point where it can firmly engage with the lock plate.

The buckle device according to the present invention comprises: a buckle body into which a tongue plate is inserted; a lock member swingably fit in said buckle body, drivable between a first position where the tongue plate engages and is locked with said lock member, upon insertion to a predetermined depth, and a second position where the engagement between the lock member and the tongue plate is released, the lock member being at all times urged by a 1st urging member, in a direction toward said first position; an ejector urging the tongue plate, which has been put into the buckle body, in the direction of withdrawal of the tongue plate; and a preventing member for preventing said lock member from moving into the locus of tongue plate insertion in opposition to the force which said lst urging member applies to said lock member, until the tongue plate reaches said predetermined depth. Therefore, in the buckle device according to the present invention, putting the tongue plate into the buckle body causes said plate to press an ejection spring, whereby the ejection spring serves via the preventing member to keep the lock plate away from the locus of tongue plate insertion until the tongue plate reaches said predetermined depth where it can engage with the lock plate.

When the tongue plate reaches the predetermined depth, where the tongue plate is fully inserted, the retention of the lock plate which has thus far been maintained is terminated, whereby the lock plate is allowed to firmly engage with the tongue plate. With the arrangement referred to above, there is no contact allowed between the lock and tongue plates until the amount of tongue plate insertion reaches the predetermined depth, so as the tongue plate undergoes no frictional force from the lock plate during the act of insertion.

DESCRIPTION OF THE PREFERRED EMBODIMENT

Figure 3:
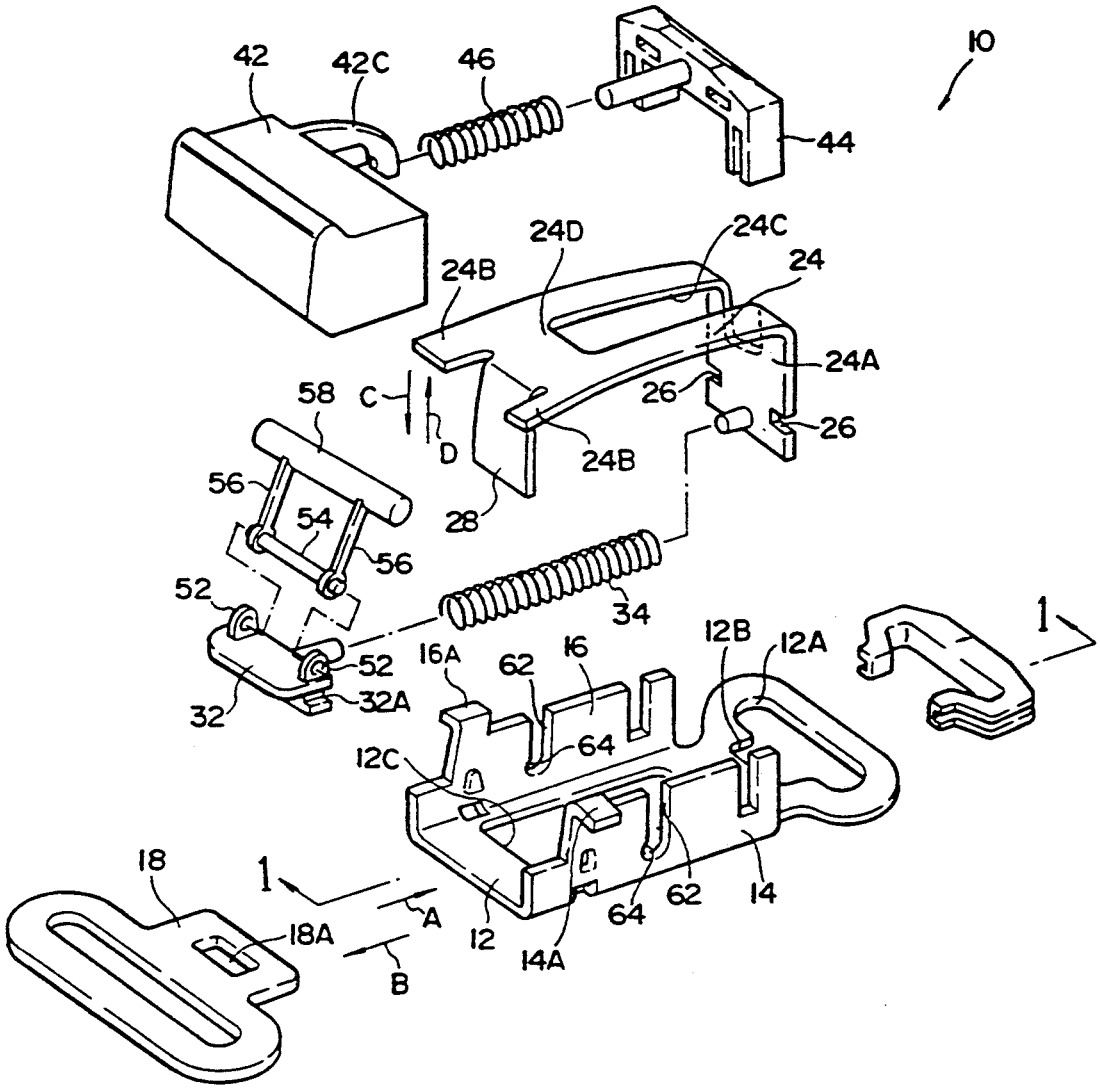
FIG. 3 is an exploded view showing the major parts of the buckle device.

As precisely illustrated in FIG. 3, the buckle device 10 of the preferred embodiment of the present invention has a buckle body 12 formed from a thin plate, wherein both sides of the buckle body are bent approximately at right angles, so as to provide respective leg portions 14 and 16.

Into the space between and defined by these leg portions, the tongue plate 18 is inserted in the direction specified by arrow A, and from said space, the tongue plate is pulled out in the direction of arrow B. An opening 12A is provided at one end of the buckle body 12, on the opposite from the side of tongue plate insertion, for use in fitting a strap 22 (see FIGS. 1 and 2) which is fixed to a car body.

The opening 12A is provided with a recess 12B in such a manner as to expand part of the opening for swingably fitting the lock plate therein. The lock plate 24, made from a thin plate, is formed by being bent into a channel-shape with a U-shaped cross-sectional profile. The bend portion at one end 24A of the lock plate has a pair of notches 26 formed at both widthwise sides of said plate. The lock plate is fit in place so as to be swingable around the pair of notches, the peripheries of these notches 26 being engaged with said recess 12B. As a consequence, the lock plate 24 is allowed to swing in two directions—one, (C-arrow direction) the direction of insertion of a lock pawl 28 protruding downward from the widthwise central portion of the end 24B of the lock plate opposite to the end having said pair of notches, into an opening 18A which is provided within the tongue plate for engagement with the lock plate pawl, and the other, (D-arrow direction) the direction of pulling the lock pawl out of the opening 18A.

The buckle body has an opening 12C formed at its central part. An ejector 32 has a pair of grooves 32A which is provided at each widthwise end, and the pair of grooves is slidably engaged to the both side edge portions of said opening 12C so that the ejector may be movable in both the tongue plate insertion and withdrawal directions (A- and B-arrow directions). A compression coil spring 34 is provided between the ejector 32 and the bend 24A of the lock plate, urging not only the ejector 32 in the tongue plate ejection direction (B-arrow direction) but also the lock plate in the direction (C-arrow direction) in which the lock pawl 28 may be inserted into the opening 18A formed within the tongue plate for engagement with said lock pawl.

Figure 1:
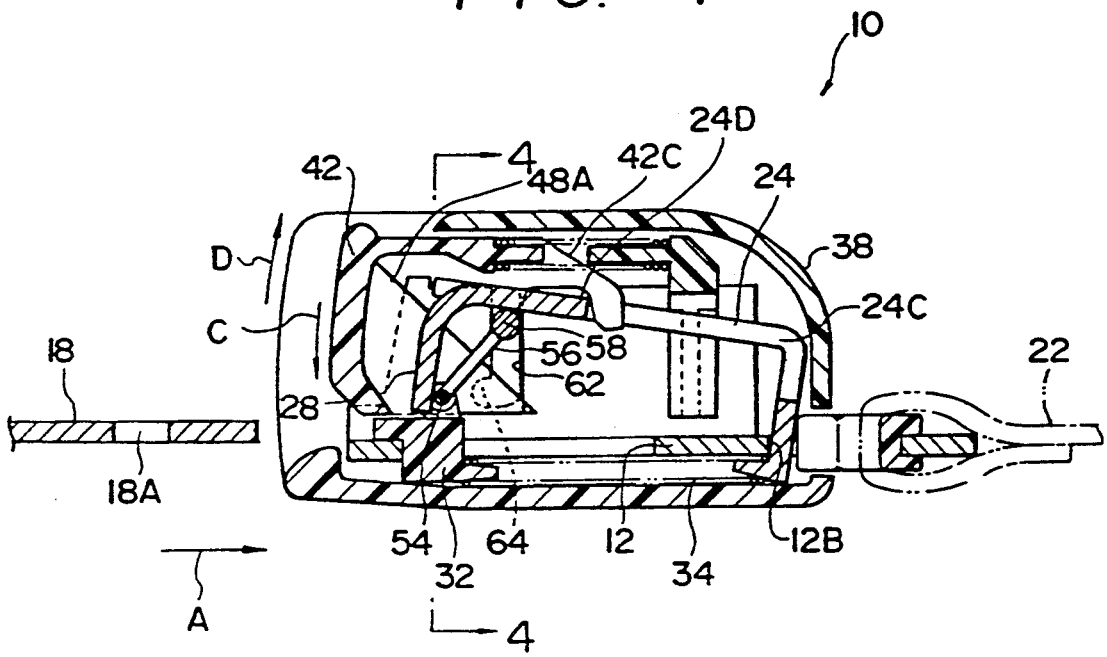
FIG. 1 is a cross-sectional view taken along the line 1—1 in FIG. 3 of a buckle device,the first embodiment of the present invention.
Figure 2:
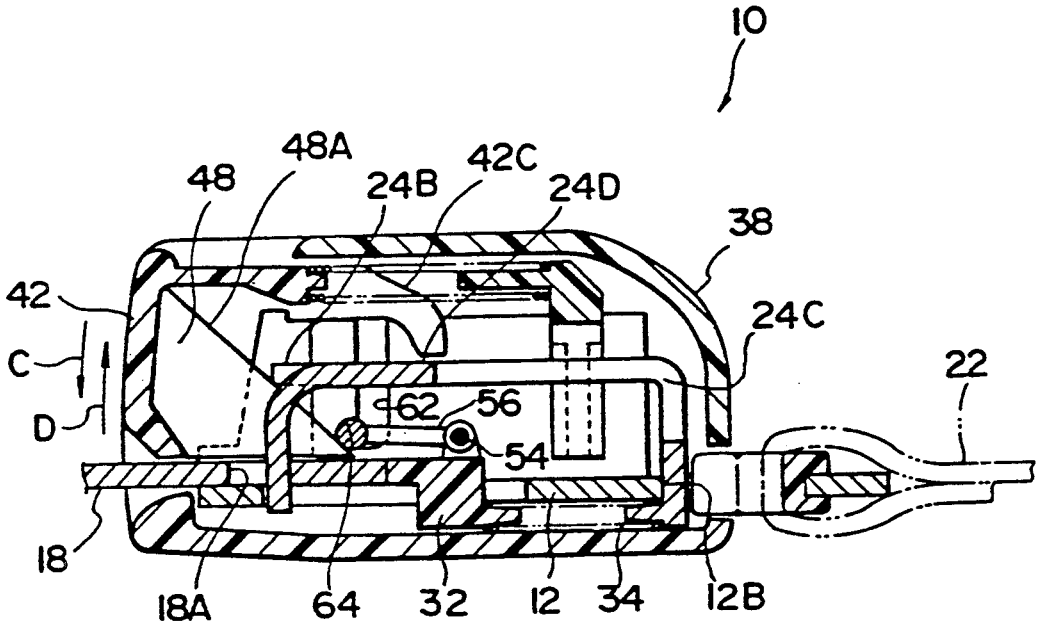
FIG. 2 is a working diagram of the buckle device in FIG. 1, showing how the tongue plate engages with the lock plate, following the insertion of the former.
Figure 4:
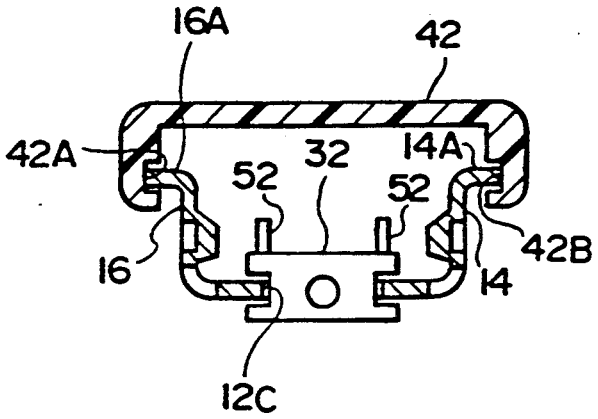
FIG. 4 is a cross-sectional view taken along the line 4—4 and which is presented in FIG. 1.

Meanwhile, as illustrated in FIGS. 1 and 2, a buckle cover 38 is furnished to house the buckle body 12. A release knob 42 is arranged to lie across the leg portions 14 and 16 of the buckle body 12. As illustrated in FIG. 4, the release knob 42 is supported against the buckle body 12 and allowed to slide in a direction orthogonal to the paper surface of FIG. 4, with L-shaped extensions 14A and 16A of the buckle body's leg portions 14 and 16 fit into respective grooves 42A and 42B which are provided in the opposite ends of the release knob 42.

A compression coil spring 46 is provided between a spring seat 44 which is mounted on the respective leg portions 14 and 16 and the release knob 42, and is urging the release knob 42 in the tongue plate withdrawal direction (B-arrow direction).

The release knob 42 has a cam protrusion 48 formed as a counterpart to a lock plate end 24B, as illustrated in FIG. 2. An inclination 48A of the cam protrusion 48 comes into engagement with the lock plate end 24B when a driver or a passenger pushes the release knob 42 into the buckle cover 38, whereby the lock plate 24 is force-awayed in the direction (D-arrow direction) of releasing the engagement with the tongue plate.

The ejector 32 has a pair of brackets 52 formed protruding above the ejector surface, with a pin 54 set across these brackets and supported thereupon. A pair of arms 56 extend from the pin 56, and a pin 58 limiter means is fixed across the respective tips of the pair of arms 56. The pin 58 is situated inside the lock plate 24, with the axial ends of said pin received in respective guide slits 62 formed within the leg portions 14 and 16, so as to be movable in the directions of contacting and separating from the lock plate 24.

Arranging the ejector 32 over the path of the lock pawl 28 when the tongue plate 18 is outside the buckle body 12 as shown in FIG. 1, brings the pin 58 into proximity with the inner surface of the lock plate 24. Inserting the tongue plate 18 into place within the buckle body, and thereby moving the ejector 32 together with the tongue plate 18 in the A-arrow direction, raises the pin 58 along inside the guide slit 62 in the upward direction shown in FIG. 1, whereby the pin 58 holds the lock pawl 28 up, so as to prevent the lock pawl 28 from getting into the travel path of the tongue plate 18, even when the ejector 32 is pushed out of the travel path of the lock pawl 28. However, reaching the predetermined depth of insertion of the tongue plate 18, by driving it into a position where said plate is allowed to engage with the lock plate, releases the pin 58 from the state wherein it has thus far been held in contact with the lock plate 24, and brings the pin 58 into a position near the lower ends of each guide slit 62 as shown in FIG. 2, whereby the lock pawl 28 of the lock plate 24 is made ready to go into the opening 18A provided in the tongue plate for engagement with the lock pawl 28.

The bottom of each guide slit 62 has a recess 64 formed so as to substantially expand the width of the guide slits in a direction toward the tongue plate insert area of the buckle body (horizontally crosswise direction in FIGS. 1 and 2). Thus, as shown in FIGS. 2, the locking mechanism is so devised that the pin 58 once set in the recess 64 is prevented from coming out therefrom, so as to assure that the lock plate 24 is prevented from being pushed up by the ejector 32, whereas, if the driver or the passenger thrusts in the release knob 42 while the pin 58 is held in the recess 64, the inclination 48A of causes the pin 58 to be driven out of the recess 64, allowing the pin 58 to move up toward the upper end of the guide slit 62.

Further, an arm 42C projects from the release knob 42, as shown in FIG. 3, and as specified in FIG. 2, and as long as the tongue plate is kept locked, said are is maintained in proximity to the periphery 24D of an opening 24C provided in the lock plate 24. The result is that under the condition referred to above, the lock plate 24 is prevented from swinging in the lock release direction D-arrow direction) even when some acceleration force 15 applied (in the upward direction of FIG. 2). However, when the release knob 42 is thrusted in the A-arrow direction, the arm 42C moves into the space of the opening 24C, so that the lock plate 42 is rendered swingable.

Now, how this preferred embodiment works is described hereunder. With reference to FIG. 1, it is illustrated therein that when the tongue plate 18 is outside the buckle body 18, the ejector 32 is situated at the stroke end within the rectangular opening 12C because of the urging force from the compression coil spring, and the lock pawl 28 of the lock plate is driven upon the ejector, so that, even when the lock plate 24 is urged in the direction toward engagement with the tongue plate 18, the lock plate is prevented from going the path of the tongue plate.

When the driver or the passenger thrusts the tongue plate 18 into the buckle body 12 to put on the seatbelt, the ejector 32 with which the tongue plate 18 has been brought into contact in its cycle of insertion, moves together with the tongue plate 18 in the A-arrow direction, against the urging, force from the compression coil spring. As a consequence, an increase in the depth of tongue plate 18 insertion entails a state where the ejector fails to keep the lock pawl retained thereon. Precisely in this state where the lock plate 24 is held in a raised position by the pin 58 which has been driven up inside the guide slit 62 by the arm 56, the lock pawl is not allowed to enter the path of the tongue plate 18, and the tongue plate undergoes no friction force stemming from the lock pawl 28.

Therefore, suspension of insertion of the tongue plate 18 midway in its inward-stroke causes the ejector 32 to reliably, and assuredly drive back the tongue plate 18 out of the buckle body 12 by urging force, with no chance of the tongue plate being caught inside the buckle body at a any point in its inward-stroke.

Reaching the predetermined depth of insertion at which the tongue plate 18 is driven into the place where it can engage with the lock plate 24 coincides with attainment by the arm 56 of an approximately horizontal position as shown in FIG. 2, resulting in the lowering of the pin 58 to the bottom of the two guide slits 62, and finally said pin is held in the recess 64. As a result, the pin 58 is no longer allowed to engage with the lock plate 24 which is permitted to swing in the C-arrow direction owing to the urging force from the compression coil spring 34, so as to enable the lock pawl 28 to be inserted into the opening 18A which is provided in the tongue plate 18 for engagement therewith.

In the state thus attained, there is firm engagement between the tongue plate 18 and the lock plate 24, wherein the pair of notches 26, together serving as a swing axis for the lock plate 24 are located slightly closer to one side of the buckle body 12 (underside in FIG. 2) rather than at a point where the lock pawl 28 could get caught in the opening 18A in the tongue plate, so that even when the force acting to pull out the tongue plate grows large, the lock plate 24 is not allowed to swing in the direction of withdrawal of the lock pawl from the opening 18A; instead, the lock plate receives some turning torque in the counterclockwise direction in FIG. 2, whereby firm engagement between the tongue plate 18 and the lock plate 24 is assured.

To release the tongue plate 18 from engagement with the lock plate 24, the release knob 42 is pushed into the buckle cover 38. When the release knob 42 is thrust into the buckle cover, the inclined edge 48A of the cam protrusion 48 is caused to work, driving the pin 58 off the two recesses 64, so that the ejector 32 presses the tongue plate 18 in the withdrawal direction, as a result of the urging force from the compression coil spring 34, and the pin 58 causes the lock plate to swing 24 in the direction (D-arrow direction) of the disengagement from the tongue plate 18, so as to pull the lock pawl 28 out of the opening 18A, thus releasing the tongue plate from engagement with the lock plate 24. As a consequence of disengagement, the tongue plate 18 receives the urging force from the compression coil spring 34 through the ejector 32, and thus is driven out of the buckle device 10.

In the above-described embodiment of the present invention, the arm 56 and the pin 58 serve together to keep the ejector 32 and the lock plate 24 functioning in concert with each other until the tongue plate 18 reaches the predetermined depth of insertion where it can engage with the lock plate 24. However, an alternate embodiment may include such limiting means as cam means or the like interposed between the ejector can the lock plate 24 which perform a similar function to that of the arm 56 and the pin 58.

Figure 5:
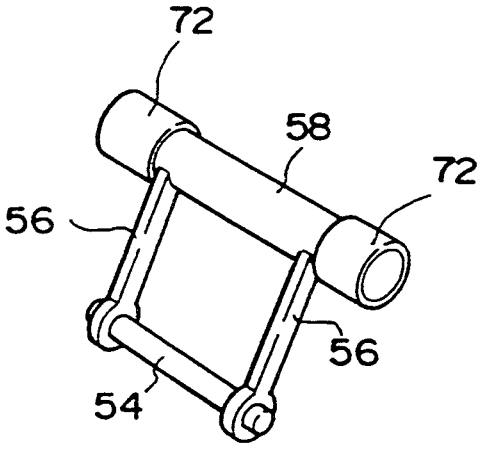
FIG. 5 is a perspective view showing the second embodiment of the present invention.

Illustrated in FIG. 5 is the pin 58 associated with the second preferred embodiment of the present invention. The pin 58 has a roller 72 provided at each axial end thereof for swingably supporting the pin, whereby, in the second embodiment, the friction resistance among the two roller 72, guide slit 62 and lock plate 24 is lessened.

Further, either embodiment may include a spring rendering a small pressing force to said arm 56 so as to swing it in the counterclockwise direction in FIG. 1, around a center comprised of the pin 54.

What is claimed is:

1. A buckle device, into which a tongue plate is inserted and engaged therewith, for use in a seatbelt system comprising:

(a) a buckle body into which a tongue plate is inserted;

(b) a lock member supported by said buckle body in such a manner that said lock member is movable between a first position where said lock member engages and is locked with said tongue plate inserted into said buckle body to a predetermined depth, and a second position where said lock member is released from engagement with said tongue plate, said lock member being at all times urged by a first urging means in a direction toward said first position;

(c) an ejector urging said tongue plate, which has been inserted into said buckle body, in a direction of withdrawal; and (d) preventing means mounted movably on said ejector for preventing said lock member from moving into the path of said tongue plate in opposition to said urging force from said first urging means, said preventing means engaging said lock member while said tongue plate is being inserted into said buckle body and disengaging said lock member when said tongue plate reaches said predetermined depth; whereby, during the insertion of said tongue plate into said buckle body, friction force from said lock member is eliminated, and said tongue plate is reliably engaged with said lock member.

2. A buckle device according to claim 1, wherein said ejector is slidably mounted on said buckle body and is arranged so as to be capable of being thrust in when said tongue palate is inserted into said buckle body and of urging in the direction of withdrawal of said tongue plate.

3. A buckle device according to claim 1, wherein said lock member includes a first end that engages said tongue plate, and a second end, said lock member being journaled to said buckle body between said first and second ends, and wherein said first urging means is provided between said ejector and said second end of said lock member to give an urging force to said ejector so that said ejector may perform the function of ejecting said tongue plate while simultaneously urging at all times said first end of said lock member toward said first position.

4. A buckle device according to claim 1, wherein said buckle body is furnished with guide means which guides said preventing means towards and away from said lock member.

5. A buckle device according to claim 4, wherein said guide means is provided with a retainer to hold said preventing means while said lock member is in engagement with said tongue plate.

6. A buckle device according to claim 4, wherein said preventing means is provided with at least one roller to lessen the friction force produced between said preventing means and said guide means and said lock member, respectively.

7. A buckle device according to claim 1, wherein the end of said lock member with said tongue plate is in contact with said ejector when said tongue plate is out of said buckle device, and prevents said lock member from getting into the insertion path of said tongue plate.

8. A buckle device according to claim 1 further comprising a release means which moves relative to said buckle body to release the engagement between said lock member and said tongue plate; said release means being provided with an arm member restricting said lock member from moving from said first position to said 2nd position while said tongue plate and said lock member are in engagement with each other second urging means which urges said release means in the direction of withdrawal of said tongue plate, and cam means which, when said release means is pressed in an engagement releasing direction in opposition to the urging force from said second urging means, moves said lock member in the direction of releasing the engagement between said lock member and said tongue plate so as to release said engagement.

9. A buckle device according to claim 8, wherein said cam means has an inclined cam face which, when said release means is pressed so as to slide in opposition to the urging force from said second urging means, comes into contact with and pushes said lock member up, thereby releasing the engagement between said lock member and said tongue plate.

10. A buckle device according to claim 9, wherein said inclined cam face contacts not only the end of said lock member but also said preventing means so as to release the engagement between said lock member and said tongue plate.

11. A buckle device into which a tongue plate of a motor vehicle seatbelt system is inserted, comprising;

(a) a buckle body supported on a vehicle body, and into which said tongue plate is inserted;

(b) a lock member journaled to said buckle body so as to be movable between a first position where said tongue plate, having been inserted into said buckle body to a predetermined depth, engages with said lock member, and a second position where the engagement therebetween is released;

(c) ejecting means provided in said buckle body, having an ejector slidably arranged on said buckle body, and a preventing means including arm members swingably mounted on said ejector, and a pin member mounted to the end of said arm members, for engaging and thus preventing said lock member from moving into the insertion path of said tongue plate unless and until said plate is inserted into said buckle body to said predetermined depth, whereupon said pin member disengages said lock member;

(d) first urging means arranged between said ejecting means and said lock member to urge said ejecting means so that said ejecting means may urge said tongue plate in the direction of withdrawal thereof, and to urge said lock member in the direction of engagement with said tongue plate at all times; and (e) releasing means supported by said buckle body so as to be movable relative to said buckle body, which, when pressed, releases the engagement between said lock member and said tongue plate and enables said ejecting means to eject said tongue plate.

12. A buckle device according to claim 11, wherein said buckle body is provided with guide means for guiding said pin, member in two respective directions, one for engagement with said lock member and one for parting therefrom ,and a retainer for holding said pin while said lock member and said tongue plate are in engagement with one another.

13. A buckle device according to claim 11, wherein the end of said lock member which engages with said tongue plate is in contact with said ejector when said tongue plate is out of said buckle device, said arrangement preventing said lock member from getting into the insertion path of said tongue plate.

14. A buckle device according to claim 11, wherein said releasing means has an arm means restricting movement of said lock member while said tongue plate and said lock member are in engagement with each other, second urging means for urging said releasing means in said tongue plate withdrawal direction, and cam means for, when said releasing means is pressed in an engagement releasing direction in opposition to the impetus from said second urging means, driving said lock member in the direction of releasing the engagement between said lock member and said tongue plate.

15. A buckle device according to claim 14, wherein said cam means has an inclined cam face which, when said releasing means is pressed and caused to slide in opposition to the impetus from said second urging means, comes into contact with said lock member and said pin member so as to release the engagement between said lock member and said tongue plate.

16. A buckle device for use in a motor vehicle seatbelt system which is arranged so as to be capable of reliably engaging with a tongue plate inserted, comprising;

(a) a buckle body supported by the vehicle body, formed from a thin plate with both lateral sides bent approximately orthogonally, and having a central opening, and which receives said tongue plate in the space between said lateral sides;

(b) a lock plate formed into a channel shape having a "U" shaped lengthwise cross-sectional profile and which is supported movably by said buckle body through a notch provided at the edge of one bent end, and having an engaging pawl at the edge of the other bent end, said engaging pawl being driven into an opening formed in said tongue plate, and engaging therewith so as to lock the tongue plate in place;

(c) an ejector arranged in said opening in said buckle body so as to slide in the insertion/withdrawal directions of said tongue plate, and functioning to drive said inserted tongue plate back out of the buckle body;

(d) a preventing means including pin member movably mounted on said ejector via an arm member and positioned under said lock plate, serving to remove said lock plate from the insertion path of said tongue plate while said tongue plate is being inserted into its place, wherein said pin disengages said lock plate when said tongue plate is inserted a predetermined distance in said buckle body;

(e) a resilient member provided between said ejector and said lock plate, urging said ejector in the direction of withdrawal of said tongue plate and said lock plate in the direction of engagement with said tongue plate; and (f) releasing means slidably supported on said buckle body, and furnished with said arm member restricting said lock plate from moving in the direction of releasing the engagement with said tongue plate while said tongue plate and said lock plate are in engagement with one another, and an inclined can face which comes into contact with the end of said lock plate and said pin member whereby the engagement between the lock plate and said tongue plate is released by pressing said releasing means and thereby imparting a force which is then applied via said cam face to said lock plate to release said engagement.

17. A buckle device according to claim 16, wherein each of the two lateral bends forming respective leg portions of said buckle body are provided with both a guide slit guiding said pin member in the directions of coming into contacting with said lock member and separating therefrom, and a retaining part to hold said pin member while said tongue plate and said lock plate are in engagement with each other.

18. A buckle device according to claim 16, wherein said engaging pawl of said lock plate is in contact with said ejector when said tongue plate is out, prohibiting said lock plate from getting into the insertion path of said tongue plate.

19. A buckle device, into which a tongue plate is inserted and engaged therewith, for use in a seatbelt system comprising:

(a) a buckle body into which a tongue plate is inserted;

(b) a lock member having first and second ends and being movably mounted in said buckle body into a first position where said first end engages and is locked with said tongue plate inserted into said buckle body to a predetermined depth, and a second position where said firs tend is released from said tongue plate;

(c) an ejector urging said tongue plate, which has been inserted into said buckle body, in a direction of withdrawal;

(d) a single urging means disposed between said ejector and the second end of said lock member for urging at all times said lock member into said first position and said ejector into said direction of withdrawal, and (e) preventing means mounted movably on said ejector for preventing said first end of said lock member from moving into the path of said tongue plate in opposition to said urging force from said urging means until said tongue plate is inserted into said buckle body said predetermined depth, whereby friction is eliminated between said tongue plate and said lock member when said tongue plate is inserted into said buckle body.

20. A buckle device as defined in claim 19, wherein said urging means is a coil spring whose axis of rotation is linearly disposed between said ejector and said second end of said lock member.

* * * * *